United States Patent [19]

Stone

[11] Patent Number: 4,817,961

[45] Date of Patent: Apr. 4, 1989

[54] FLYING TOY WITH RETURN-FLIGHT FLYING PATTERN

[76] Inventor: Myron Stone, 614B Gregory Ave., Weehawken, N.J. 07087

[21] Appl. No.: 156,464

[22] Filed: Feb. 16, 1988

[51] Int. Cl.[4] ..... A63B 65/08

[52] U.S. Cl. ..... 273/426

[58] Field of Search ..... 273/426; 446/36–43, 446/255, 256, 258, 239

[56] References Cited

U.S. PATENT DOCUMENTS

| | | | |
|---|---|---|---|
| 692,608 | 2/1902 | Bristow | 273/426 |
| 1,373,371 | 3/1921 | Vierling et al. | 446/258 X |
| 1,802,386 | 4/1931 | Kline | 446/40 |
| 2,564,053 | 8/1951 | Donovan | 446/40 |
| 2,972,481 | 2/1961 | Shapiro | 446/36 X |
| 3,403,909 | 10/1968 | Cleveland et al. | 273/426 |

FOREIGN PATENT DOCUMENTS

| | | | |
|---|---|---|---|
| 649428 | 9/1962 | Canada | 446/36 |
| 718215 | 11/1954 | United Kingdom | 273/426 |
| 2053010 | 2/1981 | United Kingdom | 446/36 |

*Primary Examiner*—Paul E. Shapiro

*Attorney, Agent, or Firm*—Samuelson & Jacob

[57] ABSTRACT

A flying toy includes first and second blade-like members which are packaged, shipped and stored unassembled in a flat, compact configuration and are erected readily into an assembled, bowed configuration suitable for flight in a return-flight pattern, the blade-like members being assembled by threading one member through slots in the other member, the slots being arranged so that the threading itself establishes forces in the members which secure the members together in the erected configuration and provide at least one of the members with the appropriate dihedral, when assembled, for stable flight of the flying toy through the return-flight pattern.

16 Claims, 2 Drawing Sheets

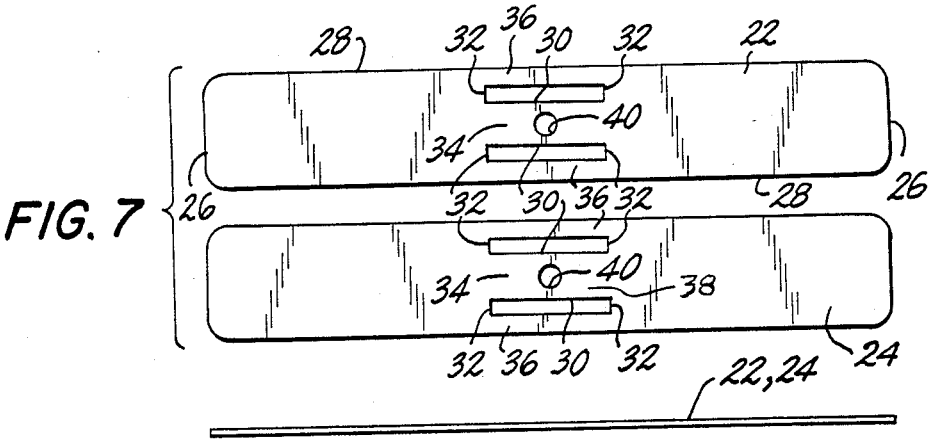
FIG. 7
FIG. 8
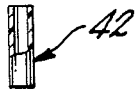
FIG. 9
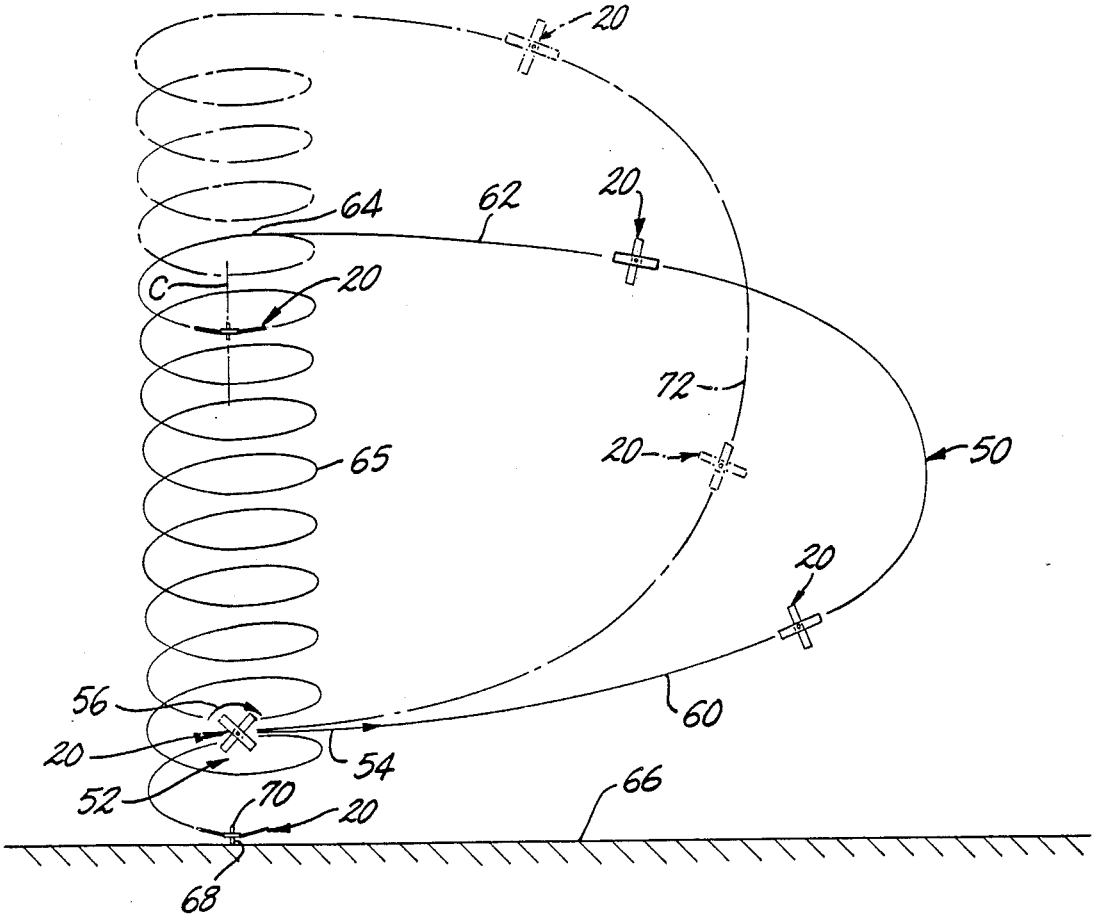
FIG. 10

FLYING TOY WITH RETURN-FLIGHT FLYING PATTERN

The present invention relates generally to flying toys and pertains, more specifically, to flying toys of the type which are packaged, shipped and sold in an unassembled, compact form and are erected readily into an assembled configuration for flight in a return-flight pattern.

Flying toys of the type which tend to return to the location from which they are launched have been popular for a very long time. Many of these toys take the form of a boomerang constructed of a wide variety of materials in many different sizes. It has been suggested that a boomerang-like toy can be constructed in the form of assembled airfoil-shaped blades which, when thrown properly, will act somewhat like a boomerang and will spin like a propeller. Thus, U.S. Pat. No. 2,972,481 discloses a rotating airfoil device in which airfoil-shaped blades are constructed of a resilient sheet material, such as cardboard, and are assembled into a bladed boomerang or propeller toy. Folds in the blades serve to establish the airfoil shape and an interlocking arrangement between the blades maintains the desired configuration. The provision of variable flight characteristics in a boomerang is disclosed in U.S. Pat. No. 3,403,909.

The present invention provides a flying toy of the type including blade-like members arranged in a device that will follow a return-flight flying pattern, but has a much simplified structure which attains several objects and advantages, some of which are summarized as follows: ease of packaging in an essentially flat, relatively thin package for compact shipping and storage; minimum number of component parts of simplified structure and relatively inexpensive materials for economy of manufacture and distribution; ready assembly from component parts shipped in knock-down form to a completed flying toy of unique configuration without complex assembly procedures; exemplary performance arising out of the unique configuration of the erected flying toy; superior structural integrity without complex structural components; selectively variable flight configuration for enabling selective adjustment of the pattern of flight; especially well-suited for indoor use; aesthetically attractive appearance for increased sales appeal; and ease of manufacture in large numbers of consistent high quality.

The above objects and advantages, as well as further objects and advantages, are attained by the present invention which may be described briefly as a flying toy capable of being packaged unassembled in a flat, compact configuration and erected readily into an assembled, bowed configuration suitable for flight in a return-flight pattern, the flying toy comprising: first and second essentially flat blade-like members, each member having a length extending longitudinally between opposite ends, a width extending laterally between opposite lateral edges, the length being substantially greater than the width, and an altitudinal thickness sufficient to maintain the length and width during flight, at least the second member being constructed of a bowable material, and the altitudinal thickness of the second member being thin enough to enable deliberate bowing; a pair of slots in at least the first member, the slots being located intermediate the ends of the first member and intermediate the lateral edges of the first member, the slots extending longitudinally over a length at least as great as the width of the second member and being spaced .apart laterally; and a plurality of bridging sections in the first member, and a corresponding intermediate section in the second member, at least one of the bridging sections being located between each lateral edge and an adjacent one of the slots, and at least another of the bridging sections being located between the pair of slots, such that upon threading of the second member through the slots in the first member to assemble the first and second members in erected configuration wherein bridging sections of the first member are juxtaposed with the corresponding intermediate section of the second member, and displacement of adjacent bridging sections in altitudinally opposite directions by the interposition of the intermediate section of the second member between the adjacent bridging sections of the first member, the second member will be bowed to establish the bowed configuration for flight in the return-flight pattern.

The invention will be understood more fully, while still further objects and advantages will become apparent, in the following detailed description of a preferred embodiment of the invention illustrated in the accompanying drawing, in which:

FIG. 7 is a top plan view of component parts of the flying toy;

FIG. 8 is a side edge elevational view of one of the component parts;

FIG. 9 is an elevational view of another component part; and

FIG. 10 is a pictorial view, largely diagrammatic, illustrating flight patterns followed by the flying toy.

Figure 1:
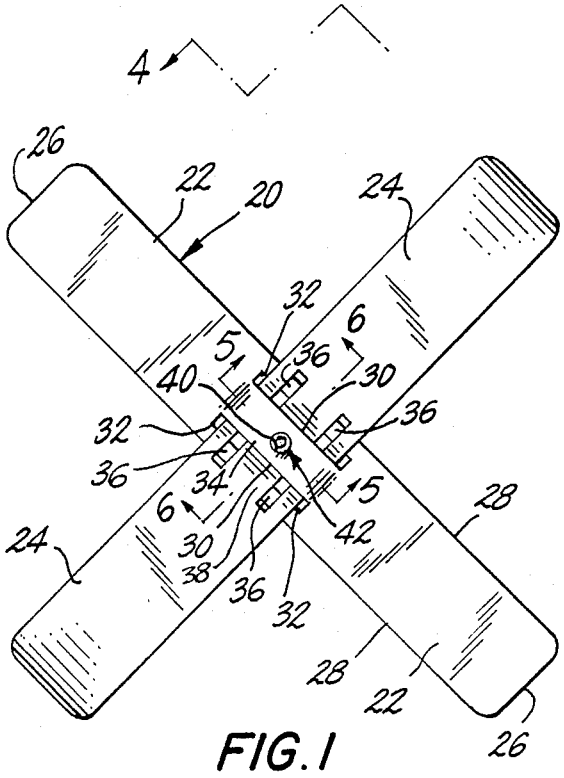
FIG. 1 is a top plan view of a flying toy constructed in accordance with the invention and erected in a flight configuration.

Referring now to the drawing, and especially to FIG. 1 thereof, a flying toy constructed in accordance with the invention is illustrated at 20 and is seen to have a first blade-like member 22 and a second blade-like member 24. Member 22 extends longitudinally between opposite ends 26 and includes opposite lateral edges 28 spaced apart laterally along the length of the member 22. The lateral edges 28 are generally parallel to one another so that the member 22 has an essentially constant width along the length thereof, with the length being much greater than the width. In the illustrated embodiment, member 24 is identical to member 22 for economy of manufacture, as well as for symmetry and balance.

Member 22 has a pair of slots 30 therein, the slots 30 being located intermediate the ends 26 of the member 22, and centrally between the ends 26. The slots 30 preferably are straight and parallel to one another and extend completely through the member 22. Each slot 30 has opposite ends 32 and the length of both slots 30 between ends 32 is the same. The lateral width of slots 30 preferably is slightly greater than the thickness of member 24, for purposes which will become apparent below. The slots 30 are spaced apart laterally and are spaced from corresponding lateral edges 28, thereby establishing a bridging section 34 of the member 22, which bridging section 34 lies between the slots 30, and further bridging sections 36 located, respectively, between each slot 30 and a corresponding lateral edge 28. The bridging sections 34 and 36 constitute strap-like elements formed unitary with the member 22. The lateral width of bridging section 34 is greater than the lateral width of either bridging section 36, and preferably is greater than the total of the widths of both bridging sections 36.

Figure 2:
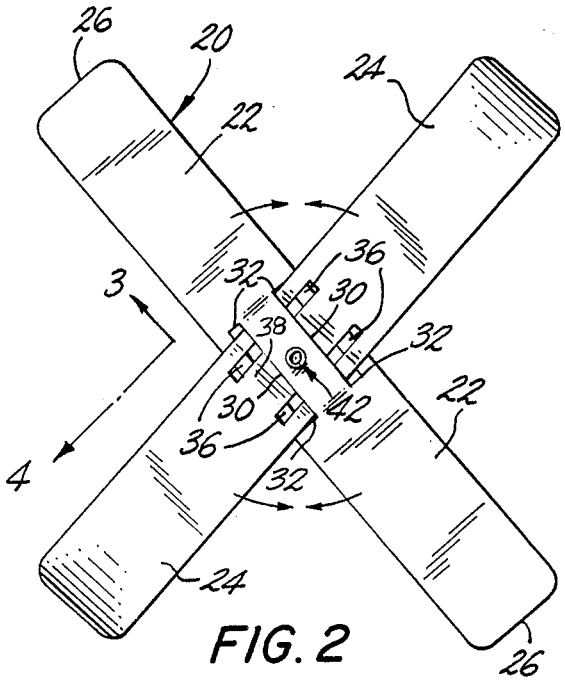
FIG. 2 is a top plan view similar to FIG. 1, but with the flying toy in an alternate flight configuration.
Figure 5:
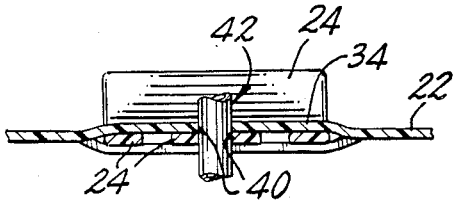
FIG. 5 is an enlarged fragmentary cross-sectional view taken along line 5—5 of FIG. 1.
Figure 6:
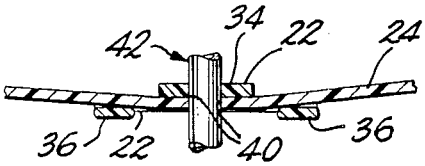
FIG. 6 is an enlarged fragmentary cross-sectional view taken along line 6—6 of FIG. 1.

Member 24 is threaded through the slots 30 in member 22 so that bridging section 34 extends over member 24 while the further bridging sections 36 extend under member 24 (also see FIGS. 5 and 6), such threading being facilitated by providing slots 30 with a lateral width slightly greater than the thickness of member 24 at the intermediate section 38 of member 24, which intermediate section 38 corresponds to the bridging sections 34 and 36 of member 22. The bridging sections 34 and 36 thus are displaced altitudinally in opposite directions and, as a result of such displacement, are tensioned somewhat. The tension induced in the bridging sections 34 and 36 by such interposition of the intermediate section 38 of member 24 between the bridging sections 34 and 36 causes the bridging sections to grip member 24 at the intermediate section 38 and establish frictional forces between the intermediate section 38 and the bridging sections 34 and 36, which frictional forces maintain the members 22 and 24 assembled, as shown. In the configuration illustrated in FIG. 1, the members 22 and 24 are perpendicular, in an orthogonal positioning, and establish an orthogonal bladed-configuration suitable for a return-flight pattern, as will be described in greater detail below. However, slots 30 are made somewhat longer than the lateral width of member 24 so that, as seen in FIG. 2, the members 22 and 24 may be rotated, relative to one another, in the directions depicted by the arrows in FIG. 2, to an oblique positioning to establish an oblique bladed-configuration for selectively changing the flight pattern, as will be described hereinafter. Members 22 and 24 each are provided with a centrally-located aperture 40 and a spindle 42 is inserted into the superimposed apertures 40. The relative dimensions of at least one of the apertures 40 and the spindle 42 is such that the spindle 42 is captured within the superimposed apertures 40 and projects altitudinally from the members 22 and 24 in both the upward and downward directions. The spindle 42 thus serves as a peg which further secures together the members 22 and 24 while enabling adjustment of the angle between the members 22 and 24 through relative rotation as described above.

Figure 3:
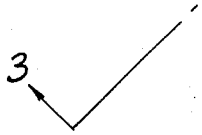
FIG. 3 is a side elevational view taken in the direction of the arrows 3—3 in FIG. 1.
Figure 3:
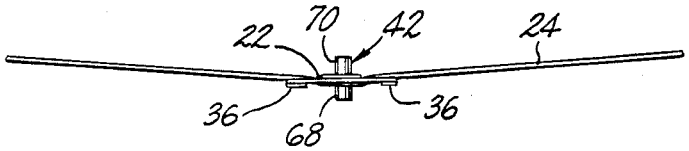
Figure 4:
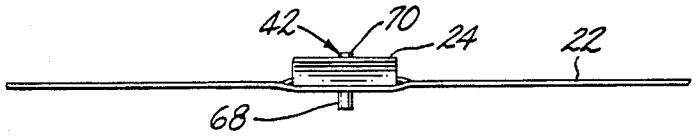
FIG. 4 is a side elevational view taken in the direction of the arrows 4—4 in FIG. 1.

As best seen in FIGS. 3 through 6, the arrangement wherein the member 24 is threaded through the slots 30 in member 22, thereby tensioning the bridging sections 34 and 36, also establishes forces which bow the member 24 into a bowed configuration, as viewed in FIG. 3. The bowed, or dished, configuration of member 24 provides the appropriate shape for stable flight of the assembled flying toy 20. Thus, the interposition of the intermediate section 38 of member 24 between the bridging potions 34 and 36 of member 22 by threading of the member 24 through the slots 30 in member 22 automatically provides the proper dihedral in the member 24 for flight of the flying toy 20 in the desired flight pattern. It is noted that the desired flight characteristics are attained by bowing only one member, namely, member 24, and it is not essential that member 22 be bowed; however, bowing of member 22 will not have an adverse effect on the flight characteristics. The material of the members 22 and 24 is chosen not only for the strength and stiffness needed to maintain the length and width of the members 22 and 24 during flight, but for the ability to bow member 24 somewhat in response to the forces exerted deliberately by the bridging sections 34 and 36 to establish the desired dihedral in member 24. In addition, the material must be lightweight for ease of flight, yet sturdy enough to withstand the rigors of play. A variety of suitable materials, such as balsa wood, cardboard and synthetic resins, are available. The preferred material is a foamed styrene which exhibits the requisite strength and rigidity, coupled with light weight and durability, in relatively thin cross-sections, and which renders the flying toy 20 especially well-suited for indoor use.

Turning now to FIGS. 7 through 9, the component parts of flying toy 20 are shown disassembled and ready for packaging. The members 22 and 24 are flat and have a thickness which is very thin when compared to the length and width of the members. For economy of manufacture, as well as ease of packaging and simplified inventory, members 22 and 24 are identical in construction. Thus, while it is not essential that member 24 be provided with slots 30, no real harm is done by the presence of the slots 30 in member 24. In fact, the placement of slots 30 in the intermediate section 38 of member 24 provides some advantage in that the member 24 is rendered more pliable in the vicinity of the corresponding bridging sections 34 and 36, thereby facilitating bowing of the member 24 in the manner and to the extent desired so that the completed assembly provides a generally symmetrical, well-balanced flying toy 20. The flat, thin structure of the members 22 and 24 renders these component parts easy to package within a relatively thin package, such as an envelope, for ready shipment and storage. The spindle 40 has a relatively small diameter and preferably is a hollow tubular structure, such as that found in a common drinking straw, for light weight.

Referring to FIG. 10, once flying toy 20 is erected, as shown in FIG. 1, the toy is ready for flight in a return-flight pattern illustrated at 50. Flying toy 20 is launched from location 52 by throwing the toy forward, in the direction indicated by arrow 54. At the same time, a spin is imparted to the toy, as depicted by arrow 56, to rotate the flying toy 20 about the central axis of rotation C, which axis of rotation coincides with the central axis of the spindle 40. The flight pattern 50 followed by the flying toy 20 includes a forward leg 60, and a return leg 62. Both the forward leg 60 and the return leg 62 extend altitudinally upwardly somewhat so that upon completion of the traverse of these legs 60 and 62, the flying toy 20 is located at 64, above the launching location 52. Forward motion of the flying toy 20 is then exhausted and the flying toy 20 will begin its descent along a descending leg 65 of flight pattern 50 to complete its return to the location 52. The bladed-configuration of the flying toy 20 assures that the toy will rotate about the central axis C, which central axis C is oriented altitudinally during the descent, and will settle gently toward a landing surface 66. When the flying toy 20 completes the descending leg 65 of the flight pattern 50 and alights upon landing surface 66, the depending portion of spindle 40 provides a projection 68 which touches down and enables continued rotation of the toy about the altitudinally oriented central axis C so that the toy will spin upon landing surface 66 until the spinning energy is dissipated and the toy comes to rest. This top-like spinning of the toy 20 enhances the performance of the toy and increases its entertainment value. It is noted that the upper portion of the spindle 40, which upper portion projects altitudinally upwardly from the central portion of members 22 and 24, provides a finger-grip 70 which can be used to impart further spinning to the toy when the projection 68 is engaged with a surface such as landing surface 66.

As indicated above, the construction and the flight characteristics of flying toy 20 render the flying toy especially well-suited for use indoors. Where flying space is limited and insufficient area is available for the full flight pattern 50 illustrated in full lines in FIG. 10, the configuration of the flying toy 20 can be adjusted selectively to an oblique configuration, as described above in connection with FIG. 2, in which configuration the flying toy 20 will follow a modified return-flight pattern 72, illustrated in phantom in FIG. 10. The modified return-flight pattern 72 is more compact in horizontal directions, but does extend altitudinally beyond the full return-flight pattern 50, resulting in a sightly longer descent along descending leg 65. Thus, the flight pattern of the flying toy 20 may be selected by changing the relative angular position of the members 22 and 24.

It will be seen that the construction of flying toy 20 enables economy of manufacture, as well as ease of packaging, transportation and storage, by providing two identical blade-like members which are flat when packaged and effect automatic contouring of the assembled toy to the appropriate configuration for flight upon erection, following a simple assembly procedure. The flying toy is especially well-suited for flight indoors and provides exemplary performance with increased entertainment value while maintaining economy.

It is to be understood that the above detailed description of a preferred embodiment of the invention is provided by way of example only. Various details of construction may be modified without departure from the true spirit and scope of the invention as set forth in the appended claims.

The embodiments of the invention in which an exclusive property or privilege is claimed are defined as follows:

1. A flying toy capable of being packaged unassembled in a flat, compact configuration and erected readily into an assembled, bowed configuration suitable for flight in a return-flight pattern, the flying toy comprising:

first and second essentially flat blade-like members, each member having a length extending longitudinally between opposite ends, a width extending laterally between opposite lateral edges, the length being substantially greater than the width, and an altitudinal thickness sufficient to maintain the length and width during flight, at least the second member being constructed of a bowable material, and the altitudinal thickness of the second member being thin enough to enable deliberate bowing;

a pair of slots in at least the first member, the slots being located centrally between the opposite ends of the first member and intermediate the lateral edges of the first member, the slots extending longitudinally over a length at least as great as the width of the second member and being straight and parallel to one another and spaced apart laterally; and plurality of bridging sections in the first member, the bridging sections being located centrally between the opposite ends of the first member, and a corresponding intermediate section in the second member, at least one said bridging section being located between each lateral edge and an adjacent one of said slots, and at least another of said bridging sections being located between the pair of slots, the second member being threaded through the slots in the first member such that the first and second members are assembled in erected configuration with bridging sections of the first member juxtaposed with the corresponding intermediate section of the second member and adjacent bridging sections displaced in altitudinally opposite directions by the interposition of the intermediate section of the second member between the adjacent bridging sections of the first member, such that the second member is bowed to establish the bowed configuration for flight in the return-flight pattern.

2. The invention of claim 1 wherein the slots each have a lateral width greater than the thickness of the second member.

3. The invention of claim 1 wherein the intermediate section of the second member includes a second pair of slots in the second member, the slots of the second pair being located intermediate the ends of the second member and intermediate the lateral edges of the second member, the slots of the second pair extending longitudinally over a length at least as great as the width of the first member and being spaced apart laterally, such that the second member is essentially identical to the first member.

4. The invention of claim 3 wherein the blade-like members each have an essentially constant width along the length thereof.

5. The invention of claim 4 wherein the bridging sections each have a lateral width less than the lateral width of the corresponding member upon which the bridging sections are located and the lateral width of the one bridging section located between the slots is greater than the lateral width of either one of the other bridging sections located between each lateral edge and a corresponding slot.

6. The invention of claim 5 wherein the lateral width of the one bridging section is greater than the total of the lateral widths of the other bridging sections.

7. The invention of claim 1 wherein the wing-like members each have an essentially constant width along the length thereof.

8. The invention of claim 7 wherein the bridging sections each have a lateral width less than the lateral width of the corresponding member upon which the bridging sections are located.

9. The invention of claim 1 wherein the length of the slots is slightly greater than the lateral width of the second member so as to permit selective relative positioning of the first and second members in either one of an orthogonal positioning and an oblique positioning for selective variation in the return-flight pattern.

10. The invention of claim 1 wherein the return-flight pattern includes a leg in which the toy descends while spinning around an altitudinal axis of rotation and the toy includes a spindle for extending along the altitudinal axis of rotation and providing a projection depending from the juxtaposed sections of the first and second members such that upon completion of the return-flight pattern, the toy will alight and spin upon the depending projection.

11. The invention of claim 10 wherein each of the first and second members includes an aperture intermediate the opposite ends and intermediate the lateral edges thereof such that the apertures are superimposed when the members are assembled into the erected flying toy, the relative dimensions of the spindle and at least one of the apertures being such that upon placement of the spindle in said one aperture, the spindle is captured within the assembled members.

12. The invention of claim 11 wherein the spindle comprises a tubular structure for light weight.

13. The invention of claim 11 wherein the spindle projects altitudinally away from the juxtaposed sections of the first and second members, in the direction opposite to the depending projection for providing a finger-grip portion on the spindle.

14. A flying toy capable of being packaged unassembled in a flat, compact configuration and erected readily into an assembled, bowed configuration suitable for flight in a return-flight pattern, the flying toy comprising:

first and second essentially flat blade-like members, each member having a length extending longitudinally between opposite ends, a width extending laterally between opposite lateral edges, the length being substantially greater than the width, and an altitudinal thickness sufficient to maintain the length and width during flight, at least the second member being constructed of a bowable material, and the altitudinal thickness of the second member being thin enough to enable deliberate bowing;

a pair of slots in at least the first member, the slots being centrally between the opposite ends of the first member and intermediate the lateral edges of the first member, the slots being straight and extending longitudinally parallel to one another over a length at least as great as the width of the second member and being spaced apart laterally; and a plurality of bridging sections in the first member, the bridging sections being located centrally between the opposite ends of the first member, and a corresponding intermediate section in the second member, at least one said bridging section being located between each lateral edge and an adjacent one of said slots, and at least another of said bridging sections being located between the pair of slots, such that upon threading of the second member through the slots in the first member to assemble the first and second members in erected configuration wherein bridging sections of the first member are juxtaposed with the corresponding intermediate section of the second member, and displacement of adjacent bridging sections in altitudinally opposite directions by the interposition of the intermediate section of the second member between the adjacent bridging sections of the first member, the second member will be bowed to establish the bowed configuration for flight in the return-flight pattern.

15. The invention of claim 14 wherein the slots each have a lateral width greater than the thickness of the second member.

16. The invention of claim 14 wherein the length of the slots is slightly greater than the lateral width of the second member so as to permit selective relative positioning of the first and second members in either one of an orthogonal positioning and a oblique positioning for selective variation in the return-flight pattern.

* * * * *